United States Patent [19]

Book et al.

[11] 4,339,939

[45] Jul. 20, 1982

[54] DRAWING HEAVY WALLED PARTS

[75] Inventors: Walter R. Book, Bethlehem; Anthony M. Putetti, Waterbury, both of Conn.

[73] Assignee: Textron, Inc., Providence, R.I.

[21] Appl. No.: 273,640

[22] Filed: Jun. 15, 1981

Related U.S. Application Data

[60] Continuation of Ser. No. 965,159, Nov. 30, 1978, abandoned, which is a division of Ser. No. 807,072, Jun. 16, 1977, Pat. No. 4,147,049.

[51] Int. Cl.[3] ..... B21D 22/00

[52] U.S. Cl. ..... 72/349; 72/348; 72/356

[58] Field of Search ..... 72/348, 349, 356, 267, 72/256, 405, 465

[56] References Cited

U.S. PATENT DOCUMENTS

| | | | |
|---|---|---|---|
| 1,697,035 | 1/1929 | Wells | 72/349 X |
| 2,434,905 | 1/1948 | Burt et al. | 72/349 X |
| 3,108,502 | 10/1963 | Chatfield | 72/354 |
| 4,121,448 | 10/1978 | Censuales | 72/348 |

*Primary Examiner*—Carl E. Hall

*Attorney, Agent, or Firm*—DeLio and Libert

[57] ABSTRACT

The method of drawing uniformly heavy walled parts in a multiple plunger machine without any intermediate anneals and a machine for carrying out the method. The method comprises a number of press operations which convert a flat blank to a final desired drawn configuration, the relatively uniform wall thickness being maintained throughout the operation by the mouth configuration of each die and by means of supplemental sleeves that assist the punches in extending the drawn shells into the dies with no stretch to the metal or thinning of walls. Work hardening due to stretch or tensile load is minimized allowing more deformation without anneals.

2 Claims, 2 Drawing Figures

DRAWING HEAVY WALLED PARTS

Figure 1A:
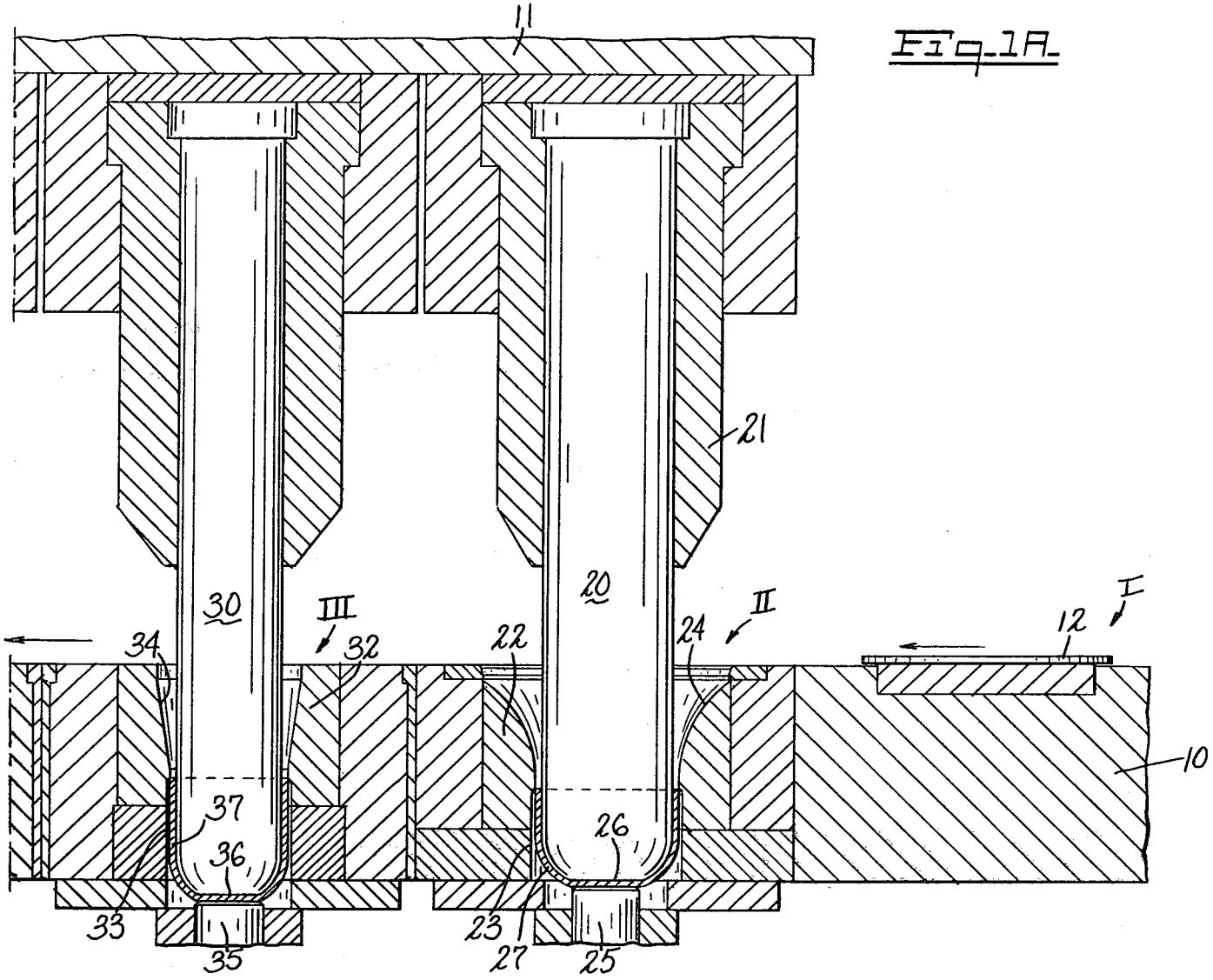

This is a continuation of application Ser. No. 965,159, filed Nov. 30, 1978, now abandoned, which was a division of application Ser. No. 807,072, filed June 16, 1977 and issued as U.S. Pat. No. 4,147,049 Apr. 3, 1979.

This invention relates to the method of drawing heavy walled parts and the machine for carrying out the method, the mouth configuration of the drawing section of the die and a set edge immediately above said section being such as to permit metal to enter the cavity between punch and die with a minimum of resistance. A slight reduction of each diameter of the shell is accomplished in the set edge immediately above the drawing die. This pre-loads the shell radially inward so as to balance any radial load outwardly as the metal flows into the die section, thus minimizing the tendency for cracking and splitting of the wall section. Uniform bottom thickness and wall thickness is maintained by the use of adjustable pressure sleeves that exert pressure on the top edge of the shell as it is proceeding into the drawing section of each die. This reduces the resistance against the bottom face of the punch and lowers the tensile load which causes stretch.

The forming of a flat blank into a cup-shaped product of several diameters in length is readily accomplished in well known punch and die forming machines when the material is relatively thin and capable of flowing without excessive work hardening, such as to require intermediate anneals. In the case of thicker materials, attempts to form cup-shaped articles have been limited due to resistance of such heavy materials on entering the draw section of each die. This has resulted in defects in the drawn shell such as punching through the bottom of the metal, excessive thinning of bottom and wall sections of the shell, and cracks and splits at the edge of the shell mouth extending into the barrel section of the drawn part.

It is accordingly an object of the present invention to so proportion the punches and dies that the bottom thickness of the cup is given its final thickness in the cupping operation and then maintained throughout subsequent steps of the operation. The sides can be shaped progressively upward from the bottom, the necessary working force being balanced between the bottom area of the punch and sleeves bearing on the upper edge of the cup, exerting a compressive force to offset the tensile load created between the bottom of the punch and the die entry.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

Figure 1B:
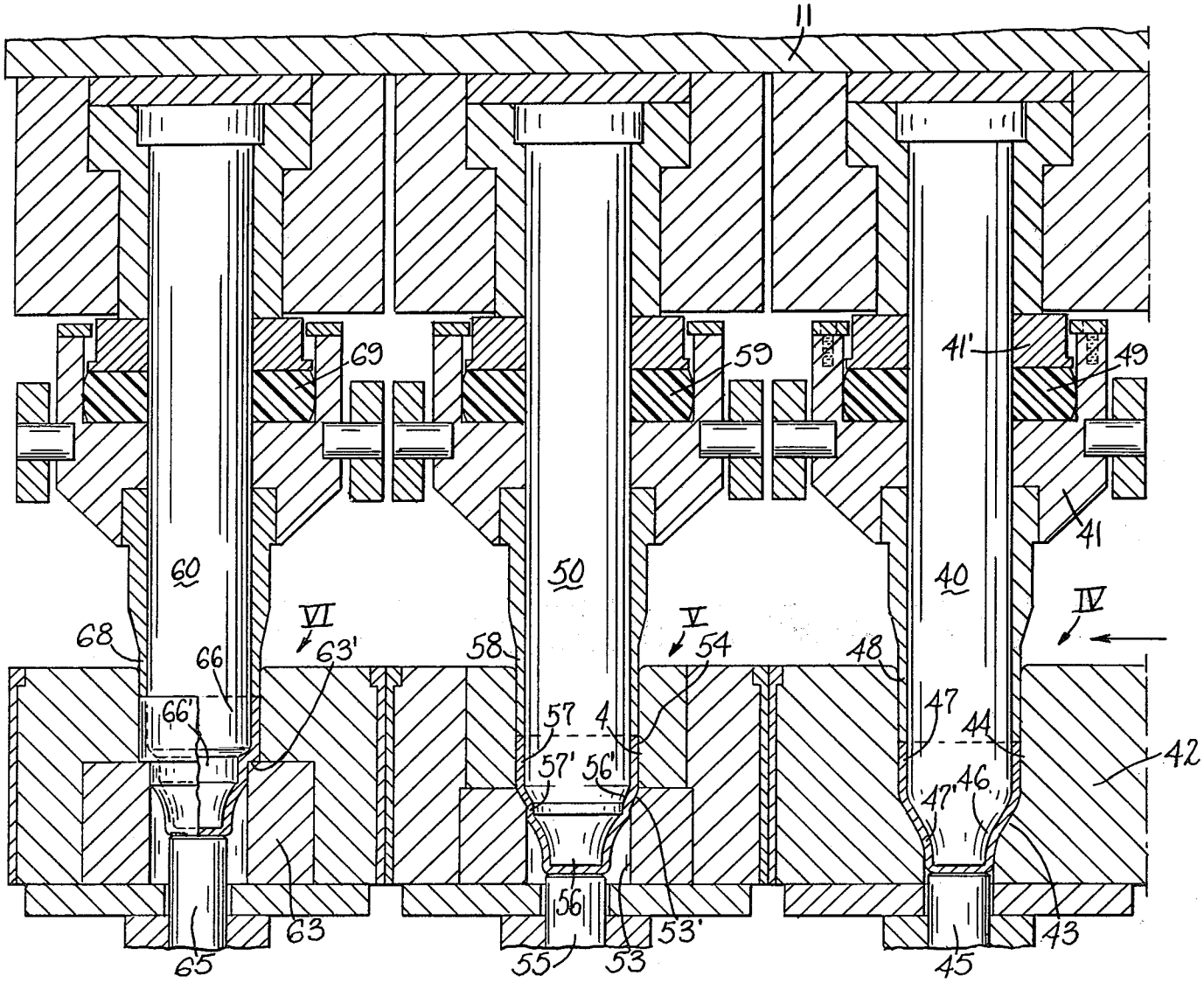

A practical embodiment of the invention is illustrated in the accompanying drawings wherein FIGS. 1A and 1B are to be viewed together, representing somewhat diagrammatic detail vertical sections showing, from right to left, six stations of the punch and die machine.

Referring to the drawings, the apparatus comprises a die bed 10 having a plurality of die stations therein and a gate 11 carrying a plurality of punches and shown in its lowest position. It will be understood that the die bed 10 is fixed to the frame of the machine and the gate 11 is reciprocated vertically in a customary manner by mechanism not shown. When the gate is retracted the work pieces or blanks are transferred by suitable transfer means, not shown, from one die station to the next, the progression being from right to left according to FIGS. 1A and 1B, and the stations being identified by the numerals I to VI.

The details of the blanking station I are not shown, being conventional. Each work piece starts as a circular blank 12 of deformable metal, particularly ferrous metal, resting in a position to be transferred to station II when the gate is retracted.

At station II, the cupping station, there is provided a punch 20 fixed in a punch socket 21 on the gate 11, and a die 22 the cavity of which has a lower cylindrical portion 23 and a widely flaring upper portion 24. The knockout pin 25 is shown as having a flat circular upper surface adapted to cooperate with the bottom end 26 of the punch in forming the bottom wall of the workpiece 27 to its desired final thickness. The punch clearance, laterally, is such as to permit the side wall of the workpiece to be drawn inward and upward with minimal inner stresses during progression of the punch into the die.

At station III, the first step drawing station, the punch 30 (supported as before) has a smaller diameter than punch 20 and the die 32 has a cavity with a lower cylindrical portion 33 and a conical upper portion 34 the major (top) diameter of which is approximately equal to the diameter of the workpiece 27, from station II. As the punch 20 drives the workpiece into the cavity 33–34 the sides of the workpiece are drawn further inward and upward with an easy distribution of the material to form the cup-shaped workpiece 37. The flat bottom, between the knockout pin 35 and the bottom end 36 of the punch, remains the same as at station II but the cup diameter is reduced and its height increased.

At station IV a further step drawing is effected as the punch 40 cooperates with the die 42, the lower portion 43 of which is necked in to begin the formation of the desired compound bottom, the lower portion 46 of the punch being correspondingly shaped. The upper portion 44 of the die cavity has substantially the same diameter as the portion 34 at station III, and the bottom of the cavity is formed by the knockout pin 45. The compressive action of the punch portion 46 on the workpiece material results in upward extrusion of the material, and the punch is here assisted by a sleeve 48 carried on a hub 41 which is mounted to move with the punch, but is permitted to have a slight "lost motion" relative to the punch by the provision of an annular plastic cushion 49. The cushion is enclosed in a cavity in the hub, the cavity being bounded upwardly by the annular stop 41', which moves with the punch. The cushion may suitably be of polyurethane, having a predetermined high resistance to compression. As the punch moves the workpiece 47 into the die cavity the lower portions of the side wall are compressed to a smaller diameter, as shown at 47', and the wall material tends to be extruded upward, bringing the upper edge of the workpiece into contact with the sleeve 48 which then acts with the punch in compressing the wall material into conformity with the working surfaces of the punch and die.

At station V a further step draw is effected by the punch 50 which has its lower end 56 shaped to support the lower part of the workpiece in the form given it at station IV. The die portion 54 is cylindrical and a lower die portion has a beveled surface 53' and adjacent cylindrical surface 53 matched by the surfaces 56' on the punch, to form a step 57' in the workpiece 57. As at station IV, the punch 50 is aided by a sleeve 58, backed by the plastic cushion 59 and so located as to bear on the edge of the workpiece and maintain compression thereon during the formation of the step.

Station VI is equipped to effect a step squaring operation by means of the punch 60, having its lower end 66 shaped as at station V but with a longer cylindrical part 66' bounded upwardly by a rather steep bevel, in positions to cooperate with the right-angled edge 63' of the lower die portion 63. At this station also the punch is aided by the sleeve 68, backed by the plastic cushion 69 so that the workpiece material being worked on by punch and die surfaces is fully enclosed and compressed, with slight resiliency, into the desired final form.

At each station the respective knock-out pin 25, 35, 45, 55 and 65 is held at the proper level to bear against the bottom of the workpiece when the punch reaches the end of its stroke and is thereafter actuated to raise the workpiece to the transfer level.

The punch and sleeve operation described above is in contrast to that in the co-pending application of Book, Ser. No. 743,218 wherein the punch and knockout pin define a cavity for the formation of a cup-shaped workpiece having a thick bottom and the sleeve is positively driven to extrude downward the material of the workpiece, insuring the complete filling of the cavity. Sleeves on punches are known, per se, as in Bailey U.S. Pat. No. 3,167,859 where the sleeve serves a knock-out function.

In carrying out the successive steps described above the redrawing at stations II and III effects minimal changes in the thickness of the workpiece due to the widely flaring die portion 24 at station II and the conical portion 34 at station III, where the die angle is about 7°, ±2°. This lets the metal enter the die without excessive resistance, whereby uniform thickness is maintained. The compensating "lost motion" action of the sleeves at stations IV, V and VI takes part of the load off the respective punches, prevents the punch from punching through the bottom of the workpiece and achieves a final product with compound rounded and squared steps with such negligible work-hardening that no intermediate annealing need be resorted to. This procedure has been followed, successfully, in drawing 4140 chromiummolybdenum steel with one-eighth inch walls, such material being very difficult to form and normally tending to workharden rapidly.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

What we claim is:

1. The method of forming heavy walled cup shaped parts without annealing which includes:

providing a multiple station punch and die machine wherein a plurality of punches are associated with sleeves which are slightly movable relatively to their respective punches;

providing a disc-shaped blank;

transferring the blank to a first station and cupping the blank to form a workpiece, the dimensions of the workpiece bottom being established in the cupping operation;

transferring the cupped blank to a die having a die angle such that the die opening is no smaller than the diameter of the blank;

drawing the blank to reduce the cup diameter and increase its height;

transferring the workpiece to a redrawing station in which the punch has a sleeve mounted for slight movement relative to the punch;

bringing the sleeve to bear on the upper edge of the workpiece to maintain compression on the workpiece material during forming; and reducing the diameter of the workpiece, while simultaneously extruding upward the wall material of the workpiece.

2. The method according to claim 1 which includes step drawing the lower portion of the workpiece.

* * * * *

UNITED STATES PATENT AND TRADEMARK OFFICE

CERTIFICATE OF CORRECTION

PATENT NO. : 4,339,939

DATED : July 20, 1982

INVENTOR(S) : Walter R. Book et al

It is certified that error appears in the above-identified patent and that said Letters Patent are hereby corrected as shown below:

Column 2, line 31 delete "20"
substitute --30--

Signed and Sealed this

Nineteenth Day of October 1982

[SEAL]

Attest:

GERALD J. MOSSINGHOFF

Attesting Officer

Commissioner of Patents and Trademarks